US005601314A

United States Patent [19]

Burns et al.

[11] Patent Number: 5,601,314

[45] Date of Patent: Feb. 11, 1997

[54] C-FOLDED PHARMACY LABEL

[75] Inventors: Susanne L. Burns, Sacramento; H. Frank Grimmett, San Jose, both of Calif.

[73] Assignee: Moore Business Forms, Inc., Grand Island, N.Y.

[21] Appl. No.: 538,810

[22] Filed: Oct. 3, 1995

[51] Int. Cl.[6] ..... B42D 15/00

[52] U.S. Cl. ..... 283/81; 283/91

[58] Field of Search ..... 283/67, 74, 75, 283/79, 80, 81, 61, 62, 96, 101, 103, 900

[56] References Cited

U.S. PATENT DOCUMENTS

| | | | |
|---|---|---|---|
| Re. 30,958 | 6/1982 | White . | |
| 1,581,170 | 4/1926 | Burdell . | |
| 2,706,865 | 4/1995 | Miller . | |
| 2,983,525 | 5/1961 | Mercur . | |
| 3,226,862 | 1/1966 | Gabruk . | |
| 3,497,982 | 3/1970 | Schulz | 283/81 |
| 3,625,547 | 12/1971 | Burke . | |
| 3,702,511 | 11/1972 | Miller . | |
| 3,946,507 | 3/1976 | Fergg et al. . | |
| 4,128,954 | 12/1978 | White . | |
| 4,159,129 | 6/1979 | Lockhart . | |
| 4,204,706 | 5/1980 | Blum et al. . | |
| 4,277,089 | 7/1981 | Lockhart . | |
| 4,295,664 | 10/1981 | Cutting | 283/900 X |
| 4,323,608 | 4/1982 | Denny et al. . | |
| 4,621,837 | 11/1986 | Mack . | |
| 4,674,771 | 6/1987 | Thompson, II . | |
| 4,706,996 | 11/1987 | Fasham | 283/900 X |
| 4,711,686 | 12/1987 | Instance . | |
| 4,748,147 | 5/1988 | Sumi-I et al. . | |
| 4,762,342 | 8/1988 | Thompson . | |
| 4,799,712 | 1/1989 | Biava et al. . | |
| 4,932,682 | 6/1990 | Miller | 283/900 X |
| 4,996,184 | 2/1991 | Bevan et al. . | |
| 5,048,870 | 9/1991 | Mangini et al. . | |
| 5,090,943 | 2/1992 | Greig et al. . | |
| 5,137,494 | 8/1992 | Schubert et al. . | |
| 5,154,668 | 10/1992 | Schubert . | |
| 5,182,152 | 1/1993 | Ericson . | |
| 5,197,922 | 3/1993 | Schubert . | |
| 5,224,897 | 7/1993 | Linden et al. . | |
| 5,267,898 | 12/1993 | Doll et al. . | |
| 5,352,155 | 10/1994 | Fahey | 283/900 X |
| 5,437,925 | 8/1995 | Macaulay et al. . | |

FOREIGN PATENT DOCUMENTS

| | | |
|---|---|---|
| 59-35981 | 2/1984 | Japan . |
| 1569625 | 6/1980 | United Kingdom . |

*Primary Examiner*—Willmon Fridie, Jr.
*Attorney, Agent, or Firm*—Nixon & Vanderhye P.C.

[57] ABSTRACT

The pharmacy label comprises top and bottom stock faces having pressure-sensitive adhesive and a release liner along one side. The labels are supplied in sheet form for passing through a printer and have die cut areas to provide a reduced width portion in the top face. The bottom face includes cold spot carbon for transferring an image. After printing, the individual labels can be separated from the sheet and the release liner pulled away from the top part and a portion of the bottom part down to a perforation line, exposing adhesive on the bottom part for application of the label to a container. By C-folding the peeled-back top part, areas of the top face can be aligned with the image transfer material between the bottom face and the container whereby, upon inscription of variable information, such information and the identification of the medication can remain on the container and a separate log created once the top face is removed from the label by peeling the remainder of the top face from the bottom face.

21 Claims, 4 Drawing Sheets

C-FOLDED PHARMACY LABEL

TECHNICAL FIELD

The present invention relates to a C-folded pharmacy label using pressure-sensitive adhesive for adherence to a medicinal container and image transfer material for transferring information inscribed on one label part to another label part for multiple record keeping purposes.

BACKGROUND

Labels with pressure-sensitive adhesive are a very versatile type of business form used in a wide variety of environments. One environment in which they are particularly useful is in the labelling of prescription medicines, such as pharmaceuticals, ointments and the like. In addition to certain non-variable information, it is oftentimes necessary to provide variable information on containers for prescription medicines, to have a record of that variable information and to be able to apply that same information in other areas, for example, as a label on a record keeping document, another container or the like. It is also often desirable to utilize labels for containers containing prescription medicines so that variable information can be imaged thereon by a non-impact printer which applies heat, such as a laser printer, in which the toner is fused by the application of heat. It is highly desirable to be able to print the labels in an efficient manner utilizing labels in sheet form in such a printer, while at the same time providing the label with later utilized image transfer capabilities.

In prior application Ser. No. 08/104,457, filed Aug. 9, 1993 of common assignee herewith, there is disclosed a pharmaceutical label for application to containers which uses a carbonless coating having microcapsules filled with dye and developer providing for image transfer capabilities. The label, as illustrated in that patent application, is also Z-folded in a specific manner to facilitate application of the label to the container, as well as to afford the label's record keeping function. The present invention constitutes an improvement over the label disclosed in that patent application and utilizes a different label configuration, as well as image transfer technology.

DISCLOSURE OF THE INVENTION

According to the present invention, a sheet containing a plurality of labels is provided and which sheet can be passed through a non-impact, e.g., laser, printer to have variable indicia imaged on the is labels of the sheet. Non-variable information can likewise be printed by the non-impact printer or preprinted during sheet formation. An impact printer may be used in conjunction with the labels of this invention, provided the image transfer materials on the label are not impacted by the printer, i.e., the labels may be impact-printed in areas other than the image transfer areas. Once variable and/or non-variable information has been printed on the labels of the sheet, the labels are detached from the sheet and applied, for example, by a drug manufacturer or at a dispensing location, to containers containing the identified medicines, ointments or the like. To accomplish this, the labels are specifically formed for ready application to the containers in a manner clearly disclosing the contents of the container and also in a manner facilitating inscription of patient/doctor-specific information on the label and enabling a portion of the label to be removed from the container and applied to an ancillary record keeping document. Particularly, each label, according to the present invention, includes face stock having a top face and a bottom face with pressure-sensitive adhesive applied to the faces along one side of the label, together with a release liner engaging the pressure-sensitive adhesive. The top face preferably includes non-variable information, for example, printed identifying areas with doctor's name, patient's name and date, while the bottom face has a similar area with substantially the same non-variable information. The bottom face also includes other areas for printing variable information, such as the identification of the medicines, ointments and the like, and other identifying indicia. The back side of the bottom face is preferably provided with cold spot carbon to provide image transfer capability when the label is folded as described hereinafter such that information inscribed on registering areas of the top and bottom faces can be transferred to a removable label part to maintain a record of the written information.

The top face and the bottom face are separated along a separation line substantially medially of the length of the label such that the top face with its release liner and a portion of the release liner along the second face can be folded back or away from part of the bottom face to lie generally parallel to the bottom face, thereby exposing a portion of the pressure-sensitive adhesive along the bottom face. The label is then applied to the container by pressing the exposed adhesive portion of the bottom face against the container. The upper face is particularly formed to have a central substantially reduced width portion having a second foldline preferably bisecting the reduced width portion into first and second parts on opposite sides of the second foldline so that the first part of the top face can be folded about the second foldline to register an information-containing area of the top face below an information-containing area of the bottom face. The first part thus lies between the bottom face and the second part. By folding the label, essentially in a C-fold, the reduced width portion also projects from the end edge of the bottom face, exposing tabs on either side of the bottom face which, upon removal of release paper, can be adhesively secured to the container to secure the bottom portion of the label to the container.

The container is thus provided the doctor or pharmacist with the bottom face adhesively secured to the container with information identifying the medication, ointments and the like in the container printed to on the label and with one of the registering areas exposed for inscription of patient-specific information by the doctor or pharmacist. By writing, for example, the patient's name, doctor's name and the date, on the one area on the bottom face, that information is transferred to the underlying area, i.e., the first part, of the upper face. The doctor or pharmacist then pulls out the upper face, using the projecting reduced width portion as a tab whereby the remainder of the liner, including the upper face, is removed. The release liner of the removed upper face is then removed whereby the first part containing the copy of the inscribed information can be adhesively secured to another document to maintain a log of the transaction. The other of the upper label portions having the non-variable information not in contact with the cold spot carbon may then be removed and can be filled out separately by the patient.

In a preferred embodiment according to the present invention, there is provided a label comprising a face stock having top and bottom faces, pressure-sensitive adhesive on the top and bottom faces, a release liner engaging the pressure-sensitive adhesive along the top and bottom faces, a line of separation between the top and bottom faces of the face stock enabling the top face with the release liner therealong and a portion of the release liner along the bottom face to be folded about a first foldline along the release liner at a location intermediate opposite ends of the bottom face and into generally parallel relation to the bottom face thereby exposing a portion of the pressure-sensitive adhesive along the bottom face for securement to a container, the folded top face with release liner having a second foldline forming first and second parts thereof on opposite sides of the second foldline for folding the first part of the top face with the release liner about the second foldline into registration with the bottom face and between the bottom face and the second part and image transfer material along a portion of the bottom face in registration with the first part of the top face folded about the second foldline for transferring indicia written on the bottom face portion onto the folded top face portion.

In a further preferred embodiment according to the present invention, there is provided a label comprising a face stock having top and bottom faces, pressure-sensitive adhesive on the top and bottom faces, a release liner engaging the pressure-sensitive adhesive along the top and bottom faces, a line of separation between the top and bottom faces of the face stock enabling the top face with the release liner therealong and a portion of the release liner along the bottom face to be folded about a first foldline along the release liner at a location intermediate opposite ends of the bottom face and into generally parallel relation to the bottom face thereby exposing a portion of the pressure-sensitive adhesive along the bottom face for securement to a container, the folded top face with release liner having a second foldline forming first and second parts thereof on opposite sides of the second foldline for folding the first part of the top face with the release liner about the second foldline into registration with the bottom face and between the bottom face and the second part and the top face having a reduced width portion intermediate its opposite ends, the bottom face having at least one tab adjacent a lower end thereof for adhesive securement to the container upon removal of release liner underlying the tab, the reduced width portion underlying the bottom face with an edge of the reduced width portion inset from an edge of the bottom face exposing the tab for securement to the container.

In a still further preferred embodiment according to the present invention, there is provided a combination of a container and a label comprising a container for prescription medicine, a label secured to the container, the label including face stock having top and bottom faces, pressure-sensitive adhesive on the top and bottom faces, a release liner engaging the pressure-sensitive adhesive along the top and bottom faces, a line of separation between the top and bottom faces of the face stock enabling the top face with the release liner therealong and a portion of the release liner along the second face to be folded about a first foldline along the release liner at a location intermediate opposite ends of the bottom face and into generally parallel relation to the bottom face thereby exposing a portion of the pressure-sensitive adhesive along the bottom face, the exposed adhesive portion bearing against the container to secure the label to the container, the folded top face with release liner having a second foldline forming first and second parts thereof on opposite sides of the second foldline, the first part of the top face with the release liner being folded about the second foldline into registration with the bottom face and between the bottom face and the second part and image transfer material along a portion of the bottom face in registration with the first part of the top face folded about the second foldline for transferring indicia written on the bottom face portion onto the folded top face portion.

In a still further preferred embodiment according to the present invention, there is provided a sheet of labels comprising a plurality of labels joined one to another along lines of weakness defining discrete labels and forming the sheets of labels, each label including a face stock having top and bottom faces, pressure-sensitive adhesive on the top and bottom faces, a release liner engaging the pressure-sensitive adhesive along the top and bottom faces, a line of separation between the top and bottom faces of the face stock enabling the top face with the release liner therealong and a portion of the release liner along the second face to be folded about a first foldline along the release liner at a location intermediate opposite ends of the bottom face and into generally parallel relation to the bottom face thereby enabling exposure of a portion of the pressure-sensitive adhesive along the bottom face for securement to a container, the top face with release liner having a second foldline forming first and second parts thereof on opposite sides of the second foldline enabling the first part of the top face with the release liner to be folded about the second foldline into registration with the bottom face and between the bottom face and the second part and image transfer material along a portion of the bottom face, the first and second foldline and the image transfer material being located relative to one another so that, upon folding the label about the first and second foldlines, the first part of the top face is enabled to lie in registration with the image transfer material for transferring indicia written on the bottom face portion onto the top face portion.

Accordingly, it is a primary object of the present invention to provide a novel and improved C-folded pharmacy label, sheets thereof and a combination of the label and the container.

BEST MODE FOR CARRYING OUT THE INVENTION

Figure 1:
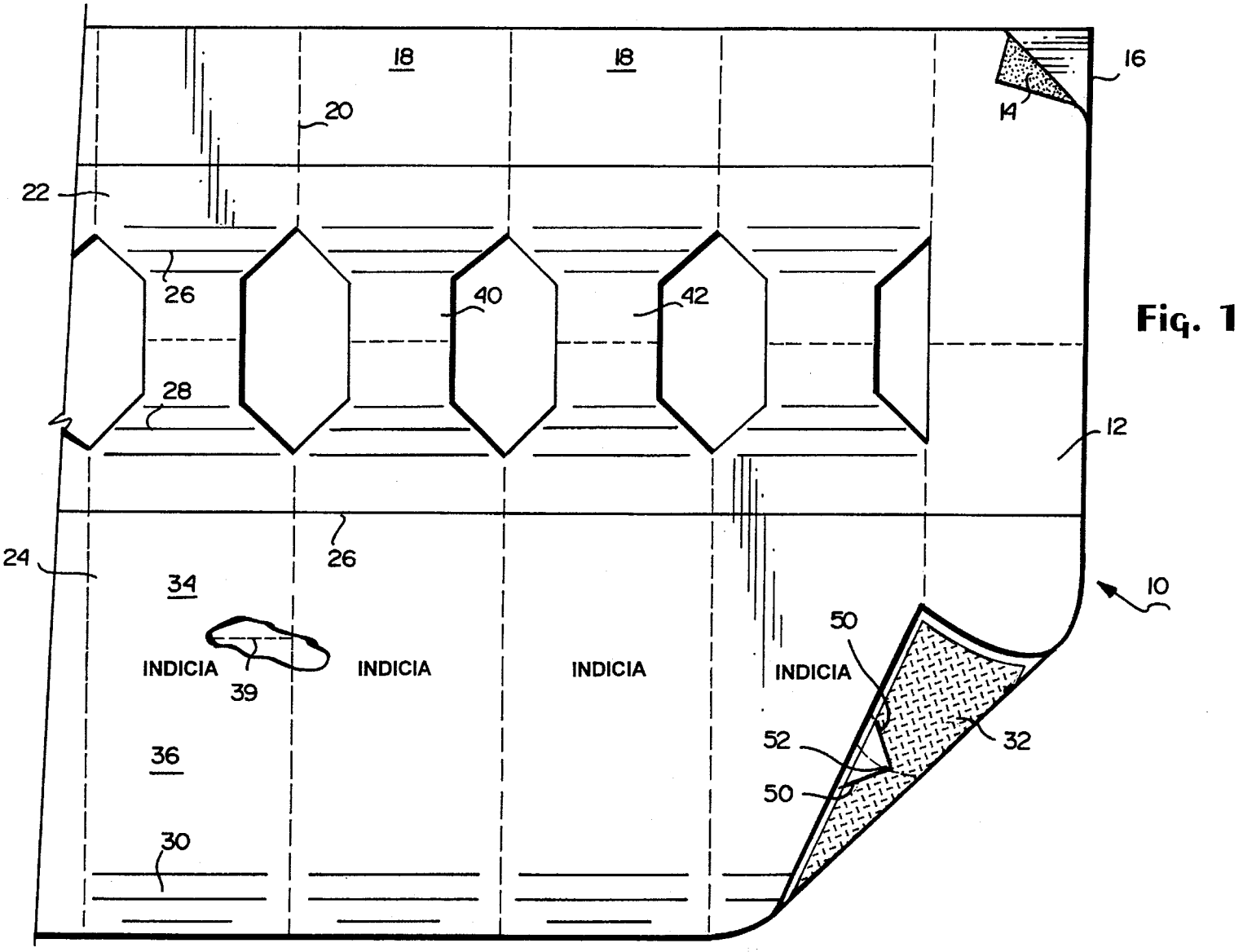
FIG. 1 is a plan view of a sheet of pharmacy labels constructed in accordance with the present invention.

Referring now to FIG. 1, there is illustrated a sheet of labels, generally designated 10, comprised of a face stock 12 having a pressure-sensitive adhesive 14 applied along its underside and a release lining 16 applied over the pressure-sensitive adhesive 14. For convenience, the pressure-sensitive adhesive 14 is applied to the entire undersurface of the face stock, although it will be appreciated that the pressure-sensitive adhesive may be applied selectively in designated areas of the face stock rather than over the entire surface. The face stock 12 is divided into a series of labels 18 separated one from the other along lines of weakness 20 which, for example, may comprise perforations through both the face stock and the release liner 16. Consequently and with reference to FIG. 1, the individual labels 18 can be separated from the sheet 10 by removing, for example, by tearing the labels from one another along the lines of weaknesses 20. For description purposes, the label may be divided into top and bottom faces 22 and 24, respectively, separated by a line of separation 26. The line of separation may be a die cut through the face stock 12 but not through the release paper 16. Thus, preferably, the top and bottom stock faces 22 and 24 are separated one from the other on sheet 10 for reasons which will become apparent.

Figure 2:
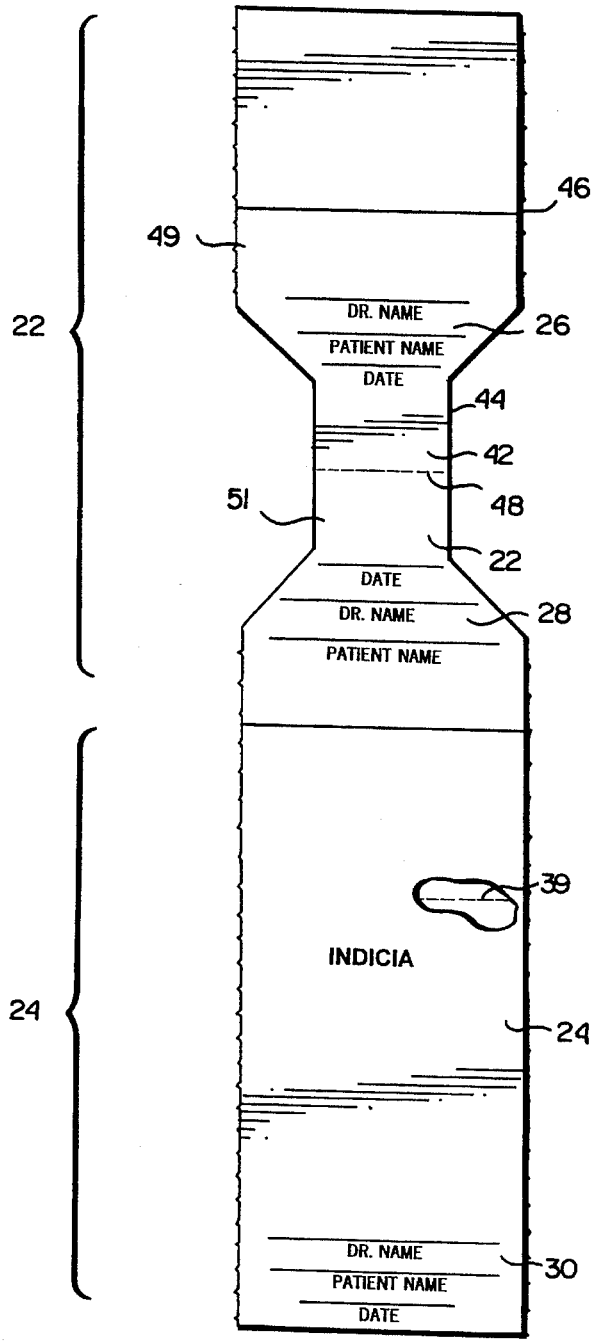
FIG. 2 is an enlarged view of a single label removed from the sheet of FIG. 1.
Figure 3:
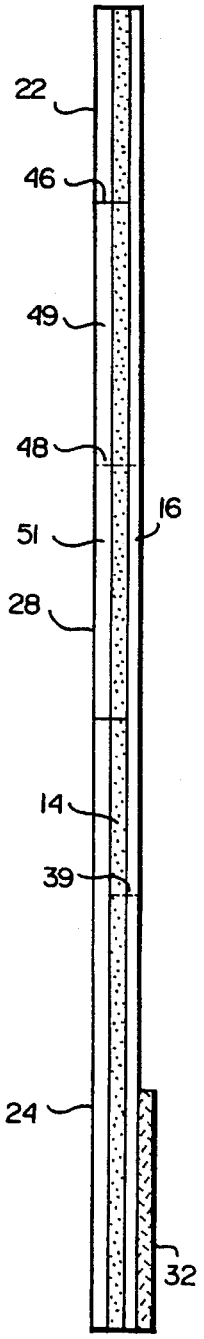
FIG. 3 is a side elevational view of the label illustrated in FIG. 2.
Figure 6:
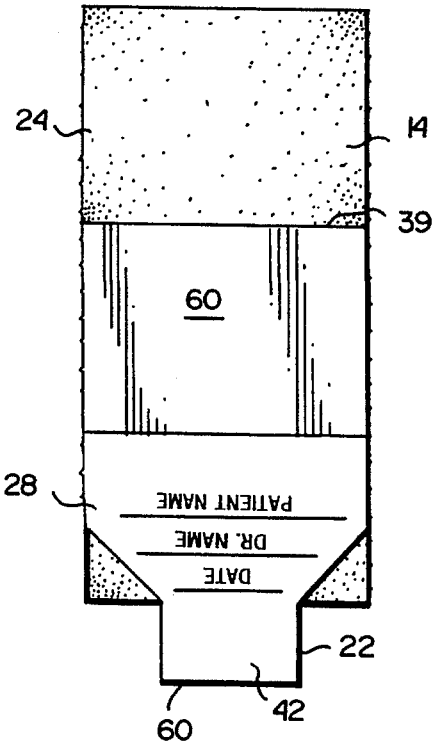
FIG. 6 is a rear elevational view of the side of the label which is applied to the container.

Referring to FIGS. 1 and 2, the top face 22 includes areas 26 and 28 on which information is printed, for example, non-variable information comprising identifying indicia for placement of a doctor's name, patient name, date or other non-variable information, as will be apparent to those of skill in the art. Bottom face 24 also includes an area 30 on which information may be printed, for example, non-variable information of the same type as the information in area 26 of the top face 22. As will be apparent from the ensuing description, the area 26 will underlie the area 30 when the label is in use so that information can be transferred from area 30 onto area 26 upon written inscription on area 30. To accomplish that, image transfer material, for example, a cold spot carbon 32, is provided along the underside of release paper 16 in registration with the area 30 of the bottom face 24. It will be appreciated that cold spot carbon is per sea known method of transferring images from one substrate to another upon inscription on the one substrate. Also provided on the bottom face 24 are areas 34 and 36 on which preprinted variable and/or non-variable information may be provided when the sheet 10 is passed through a printer, for example, a laser printer, not shown. Thus, variable information such as the identification of the medication, ointments and the like can be preprinted on areas 34 and 36. A line of perforations 39 is provided along the release liner at a location between opposite ends of the bottom face 24 for reasons noted hereinafter.

Referring again to FIGS. 1 and 2, the upper face 22 includes a series of die cuts 40 between adjacent labels 18 defining in the top face 22 reduced width portions 42. Upon removal of an individual label 18 from the sheet 10, the reduced width portion 42 defines edges 44 inset from the edges 46 of the top face 22. For purposes hereafter described, a foldline 48 is provided substantially medially of the reduced width portion 42 forming a first part 49 and a second part 51 on opposite sides thereof and along the top face 22. The bottom face 24 also has scorelines 50 defining triangularly-shaped tabs along the end corners of the bottom face 24 through both the bottom face stock and the release liner. The scorelines 50 define generally triangularly-shaped tabs 52.

A coating composition is applied to the face stock over top and bottom faces 22 and 24 to prevent smudging or smearing of the image. The composition may be of the type disclosed in U.S. Pat. No. 5,437,925 of common assignee herewith, the disclosure of which is incorporated herein by reference.

Figure 5:
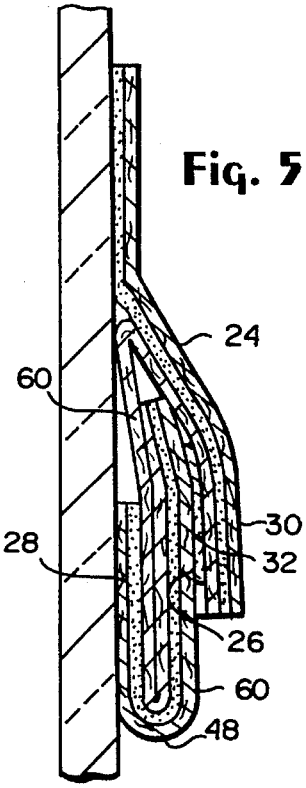
FIG. 5 is a cross-sectional view of the label applied to the container and taken generally about on line 5—5 in FIG. 4.
Figure 4:
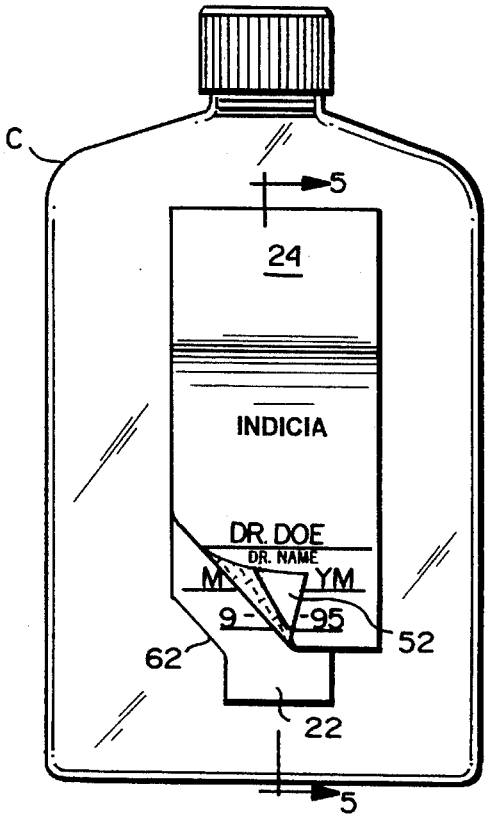
FIG. 4 is a side elevational view of the label applied to a container.
Figure 7:
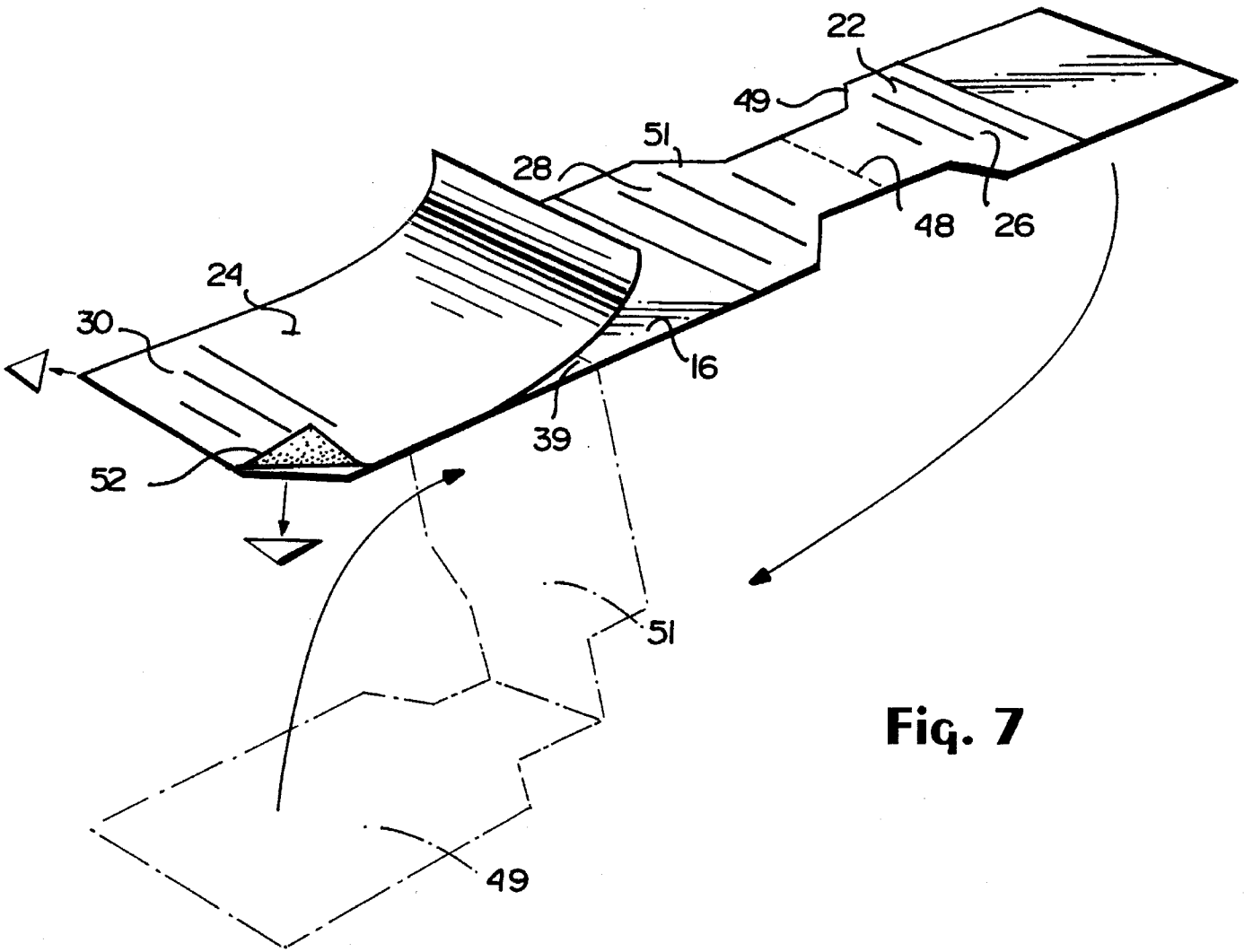
FIG. 7 is a perspective view of the label illustrating the manner of folding the label.

To use the label system hereof, the sheet 10 of labels is passed through a printer where the variable and non-variable information is printed on the labels. For example, the non-variable information may be printed in areas 26, 28 and 30, while the variable information pertaining to the identification of the medication and other essential information of that type may be printed in the areas 34, 36. Each label may then be separated from the sheet and applied to a separate container. To accomplish this, the release liner 16 along the back side of the top face 22 is peeled away from the adhesive 14 thereon down to the perforation line 39 along the bottom face 24. By peeling the liner down to the perforation line 39, it will be appreciated that the adhesive 14 along the back side of an upper portion of bottom face 24 is exposed. The label can then be applied to the container C by pressing the exposed portion of the adhesive 14 along the upper portion of bottom face 24 against container C as illustrated in FIGS. 4 and 5. The portion 60 of the release liner which has been detached from the adhesive along the back side of the upper portion of bottom face 24 as well as the top face 22 lies generally parallel to the bottom face 24. By folding the top face 22 about its mid-foldline 48, essentially forming a C-fold, the first part 49 of top face 22 may be brought into registration underlying the area 30 of the bottom face 24. The second part 51 of the top face 22, including portion 60, thus bears against the face of the container C but is not adhesively secured thereto. First part 49 extends between second part 51 and the bottom face 24 when the label is attached to container C. Note also that the reduced width portion 42 of the top face 22 forms a tab 60 which projects beyond the lower edge of the bottom face 24. The registering diagonal edges 62 of the die cut 40 also enables the triangular tabs 52 formed along the bottom margin of bottom face 24 to lie in registry with the container. By removing the release liner overlying the adhesive on the triangular tabs 52, the tabs 52 may be adhesively secured to the container C.

With the label secured as illustrated in FIG. 4, it will be appreciated that the area 26 of the first part 49 of top face 22 lies in registration with the area 30 of bottom face 24 with the image transfer material 32 therebetween. By inscribing the desired information on the area 30, the information is transferred onto the area 26 underlying area 30. Once the information has been inscribed and hence transferred, the doctor or pharmacist may pull out the upper face and the remainder of the liner by grasping the tab 60. The seal afforded by the tabs 52 may be broken when the tab 60 is pulled to remove the upper face 22 from the label but the tabs can be immediately reapplied to the container C. By removing the top face 22, the record portion 26 can be detached from the release liner and applied to a record keeping log. The remaining portion 28 is removed and can be filled out separately by the patient if desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A label comprising:

a face stock having top and bottom faces;

pressure-sensitive adhesive on said top and bottom faces;

a release liner engaging said pressure-sensitive adhesive along said top and bottom faces;

a line of separation between said top and bottom faces of the face stock enabling said top face with the release liner therealong and a portion of the release liner along said bottom face to be folded about a first foldline along the release liner at a location intermediate opposite ends of the bottom face and into generally parallel relation to the bottom face thereby exposing a portion of the pressure-sensitive adhesive along the bottom face for securement to a container;

said folded top face with release liner having a second foldline forming first and second parts thereof on opposite sides of said second foldline for folding said first part of said top face with the release liner about said second foldline into registration with the bottom face and between said bottom face and said second part; and image transfer material along a portion of said bottom face in registration with said first part of said top face folded about said second foldline for transferring indicia written on said bottom face portion onto said folded top face portion.

2. A label according to claim 1 wherein said first and second foldlines enable C-folding.

3. A label according to claim 1 wherein an intermediate portion of said top face, including said second foldline thereof, projects outwardly beyond an end edge of said bottom face when said first part is folded about said second foldline into registration with said bottom face.

4. A label according to claim 1 wherein said top face has a reduced width portion intermediate opposite ends thereof, said bottom face having at least one tab adjacent a lower end thereof for adhesive securement to the container upon removal of release liner underlying the tab, said reduced width portion underlying said bottom face with an edge of said reduced width portion inset from an edge of said bottom face exposing said tab for securement to the container.

5. A label according to claim 1 wherein said top face has a reduced width portion intermediate opposite ends thereof and edges thereof inset from lateral edges of said top face, said bottom face having a pair of tabs adjacent a lower end thereof for adhesive securement to the container upon removal of release liner underlying the tabs, said reduced width portion underlying said bottom face with said inset edges thereof inset from edges of said bottom face exposing said tabs for securement to the container.

6. A label according to claim 5 wherein an intermediate portion of said top face, including said second foldline thereof, projects outwardly beyond an end edge of said bottom face when said top face is folded about said second foldline into registration with said bottom face.

7. A label according to claim 1 including corresponding preprinted indicia provided on said first part of said top face and on said bottom face with said image transfer material on said bottom face underlying the preprinted indicia thereon, said preprinted indicia being spaced along said stock such that the preprinted indicia on said first part underlies the preprinted indicia and the image transfer material on said bottom face when said top face portion is folded into registration with said bottom face.

8. A label according to claim 1 wherein said separation line comprises a slit through said face stock but not through said release liner.

9. A label according to claim 1 including a coating composition overlying said face stock on the side thereof remote from said release paper for improved adhesion of toners to the face stock to prevent smudging.

10. A label comprising:

a face stock having top and bottom faces;

pressure-sensitive adhesive on said top and bottom faces;

a release liner engaging said pressure-sensitive adhesive along said top and bottom faces;

a line of separation between said top and bottom faces of the face stock enabling said top face with the release liner therealong and a portion of the release liner along said bottom face to be folded about a first foldline along the release liner at a location intermediate opposite ends of the bottom face and into generally parallel relation to the bottom face thereby exposing a portion of the pressure-sensitive adhesive along the bottom face for securement to a container;

said folded top face with release liner having a second foldline forming first and second parts thereof on opposite sides of said second foldline for folding said first part of said top face with the release liner about said second foldline into registration with the bottom face and between said bottom face and said second part; and said top face having a reduced width portion intermediate its opposite ends, said bottom face having at least one tab adjacent a lower end thereof for adhesive securement to the container upon removal of release liner underlying the tab, said reduced width portion underlying said bottom face with an edge of said reduced width portion inset from an edge of said bottom face exposing said tab for securement to the container.

11. A label according to claim 10 wherein said first and second foldlines enable C-folding.

12. A label according to claim 10 wherein an intermediate portion of said top face, including said second foldline thereof, projects outwardly beyond an end edge of said bottom face when said first part is folded about said second foldline into registration with said bottom face.

13. A label according to claim 10 including corresponding preprinted indicia provided on said first part of said top face and on said bottom face with said image transfer material on said bottom face underlying the preprinted indicia thereon, said preprinted indicia being spaced along said stock such that the preprinted indicia on said first part underlies the preprinted indicia and the image transfer material on said bottom face when said top face portion is folded into registration with said bottom face.

14. A label according to claim 10 wherein said separation line comprises a slit through said face stock but not through said release liner.

15. A label according to claim 10 including a coating composition overlying said face stock on the side thereof remote from said release paper for improved adhesion of toners to the face stock to prevent smudging.

16. A combination of a container and a label comprising:

a container for prescription medicine;

a label secured to said container, said label including face stock having top and bottom faces, pressure-sensitive adhesive on said top and bottom faces, a release liner engaging said pressure-sensitive adhesive along said top and bottom faces, a line of separation between said top and bottom faces of the face stock enabling said top face with the release liner therealong and a portion of the release liner along said second face to be folded about a first foldline along the release liner at a location intermediate opposite ends of the bottom face and into generally parallel relation to the bottom face thereby exposing a portion of the pressure-sensitive adhesive along the bottom face, said exposed adhesive portion bearing against said container to secure said label to said container;

said folded top face with release liner having a second foldline forming first and second parts thereof on opposite sides of said second foldline, said first part of said top face with the release liner being folded about said second foldline into registration with the bottom face and between said bottom face and said second part; and image transfer material along a portion of said bottom face in registration with said first part of said top face folded about said second foldline for transferring indicia written on said bottom face portion onto said folded top face portion.

17. A combination according to claim 16 wherein an intermediate portion of said top face, including said second foldline thereof, projects outwardly beyond an end edge of said bottom face when said first part is folded about said second foldline into registration with said bottom face.

18. A label according to claim 18 wherein said top face has a reduced width portion intermediate opposite ends thereof, said bottom face having at least one tab adjacent a lower end thereof for adhesive securement to the container upon removal of release liner underlying the tab, said reduced width portion underlying said bottom face with an edge of said reduced width portion inset from an edge of said bottom face exposing said tab for securement to the container.

19. A label according to claim 16 wherein said top face has a reduced width portion intermediate opposite ends thereof and edges thereof inset from lateral edges of said top face, said bottom face having a pair of tabs adjacent a lower end thereof for adhesive securement to the container upon removal of release liner underlying the tabs, said reduced width portion underlying said bottom face with said inset edges thereof inset from edges of said bottom face exposing said tabs for securement to the container.

20. A label according to claim 16 including corresponding preprinted indicia provided on said first part of said top face and on said bottom face with said image transfer material on said bottom face underlying the preprinted indicia thereon, said preprinted indicia being spaced along said stock such that the preprinted indicia on said first part underlies the preprinted indicia and the image transfer material on said bottom face when said top face portion is folded into-registration with said bottom face.

21. A sheet of labels comprising:

a plurality of labels joined one to another along lines of weakness defining discrete labels and forming said sheets of labels;

each label including a face stock having top and bottom faces, pressure-sensitive adhesive on said top and bottom faces, a release liner engaging said pressure-sensitive adhesive along said top and bottom faces, a line of separation between said top and bottom faces of the face stock enabling said top face with the release liner therealong and a portion of the release liner along said second face to be folded about a first foldline along the release liner at a location intermediate opposite ends of the bottom face and into generally parallel relation to the bottom face thereby enabling exposure of a portion of the pressure-sensitive adhesive along the bottom face for securement to a container;

said top face with release liner having a second foldline forming first and second parts thereof on opposite sides of said second foldline enabling said first pad of said top face with the release liner to be folded about said second foldline into registration with the bottom face and between said bottom face and said second part; and image transfer material along a portion of said bottom face, said first and second foldline and said image transfer material being located relative to one another so that, upon folding said label about said first and second foldlines, said first part of said top face is enabled to lie in registration with said image transfer material for transferring indicia written on said bottom face portion onto said top face portion.

* * * * *